US005560459A

United States Patent [19]

Lin

[11] Patent Number: 5,560,459

[45] Date of Patent: Oct. 1, 1996

[54] INTERNAL FRAME WITH A MODULAR CENTRAL FRAME FOR A WHEELED LUGGAGE

[76] Inventor: Jerhong Lin, 7548 Donegal Dr., Cupertino, Calif. 95014

[21] Appl. No.: 409,837

[22] Filed: Mar. 27, 1995

[51] Int. Cl.[6] ..... A45C 5/14; A45C 13/04; A45C 13/26; A45C 13/36

[52] U.S. Cl. ..... 190/115; 190/18 A; 190/39; 190/127

[58] Field of Search ..... 190/24, 39, 18 A, 190/115, 122, 127; 280/37, 655, 655.1; 16/115

[56] References Cited

U.S. PATENT DOCUMENTS

| | | | |
|---|---|---|---|
| 627,374 | 6/1899 | Wood | 190/122 X |
| 1,001,563 | 8/1911 | Spiro | 190/127 |
| 2,755,896 | 7/1956 | Breglia | 190/115 |
| 4,433,760 | 2/1984 | Pelavin | 190/115 |
| 4,759,431 | 7/1988 | King | 190/18 A |
| 4,995,487 | 2/1991 | Plath | 190/18 A |
| 5,167,306 | 12/1992 | Carrigan, Jr. | 190/115 X |
| 5,181,590 | 1/1993 | Carpenter et al. | 190/115 X |
| 5,197,579 | 3/1993 | Bieber et al. | 190/115 X |
| 5,253,739 | 10/1993 | King | 190/18 A |
| 5,295,565 | 3/1994 | Latshaw | 190/18 A |
| 5,330,037 | 7/1994 | Wang | 190/18 A |
| 5,350,046 | 9/1994 | Falloon et al. | 190/127 X |
| 5,431,262 | 7/1995 | Rekuc et al. | 190/127 X |

FOREIGN PATENT DOCUMENTS

| | | | |
|---|---|---|---|
| 702097 | 1/1965 | Canada | 190/115 |
| 986708 | 8/1951 | France | 190/127 |
| 1198020 | 8/1965 | Germany | 190/115 |

*Primary Examiner*—Sue A. Weaver
*Attorney, Agent, or Firm*—Keith Kline

[57] ABSTRACT

An internal frame for supporting a wheeled suitcase comprises a base, a U-shaped frame mounted on top of the base and a modular central frame comprising an L-shaped head set having an L-shaped brace and all extension board connected to the front end of the L-shaped brace, two rectangular tubes slidably connected to the lower end of the L-shaped brace, and two sockets connected to the lower ends of the two rectangular tubes. The upper end of the central frame is mounted to the top panel of the U-shaped frame and the lower end of the central frame is mounted to the rear end of the base so that the structure of the internal frame is greatly strengthened by the central frame. The modular central frame design not only can strengthen the structure of a wheeled suitcase, but is also flexible for change.

9 Claims, 3 Drawing Sheets

INTERNAL FRAME WITH A MODULAR CENTRAL FRAME FOR A WHEELED LUGGAGE

BACKGROUND OF THE INVENTION

1. Field of the Invention

This invention relates to an internal frame of a wheeled suitcase, and more particularly, to an internal frame comprising a base, a U-shaped frame mounted on top of the base, and a modular central frame mounted between the U-shaped frame and the base for strengthening the structure of the wheeled suitcase.

2. Description of the Prior Art

Wheeled suitcase are popular for traveling because they can easily be pulled rather than carried. In order to reduce tile overall weight of a suitcases, most wheeled suitcases use a light-weight internal frame with a layer of flexible material covered on its outside. In such design the internal frame becomes the most important component in supporting the structure of a wheeled suitcase.

My U.S. Pat. application Ser. No. 08/371,401, entitled AN INTERNAL FRAME FOR A WHEELED SUITCASE, filed Jan. 11, 1995, is herein incorporated by reference. The patent application describes an internal frame for supporting a wheeled suitcase comprising a base, a U-shaped frame mounted on top of the base, and a central frame installed between the base and the U-shaped frame for strengthening the structure of the internal frame. The central frame comprises a horizontal U-shaped member on its top end for supporting the top panel of the U-shaped frame. The front end of the U-shaped member can be used to support an external suitcase hanging over the front upper end of the wheeled suitcase. And the rear end of the central frame comprises a rod receiving means for receiving a slidable pull handle installed on the rear upper end of the wheeled suitcase for pulling or pushing the wheeled suitcase when it is tilted rearward.

SUMMARY OF THE INVENTION

In general, the invention features an improved central frame design for an internal frame of a wheeled suitcase. In a preferred embodiment, the present invention includes an internal frame for supporting a substantially rectangular wheeled suitcase having a flexible cover as its outer layer, the internal frame comprising:

(1) a base;

(2) a U-shaped frame having a top panel and two side panels, the lower ends of the two side panels vertically mounted to the left and right sides of the base; and (3) a central frame comprising:

(a) an L-shaped head set having a top panel and a rear panel;

(b) two substantially rectangular elongated tubes slidably connected to the lower end of the rear panel for supporting the L-shaped head set; and (c) a socket rigidly connected to the lower end of each of the rectangular tubes;

wherein the central frame is mounted between the base and the U-shaped frame by having the middle section of the top panel of tile L-shaped head set mounted to the top panel of the U-shaped frame and the two sockets on the lower end of the central frame mounted to the rear end of the base whereby the front end of the top panel of the L-shaped head set can be used to support an external suitcase hanging over the front upper end of the wheeled suitcase and the structure of the internal frame is greatly strengthened by the central frame. The L-shaped head set comprises an L-shaped brace having a top panel and a rear panel, and an extension board horizontally connected to the front end of the top panel of the L-shaped brace.

The modular central frame design not only can strengthen the structure of a wheeled suitcase, but is also flexible for change. The height of the central frame can be changed by changing the two rectangular tubes, and the length of the top panel of the L-shaped head set can also be changed by changing the extension board. Since the rectangular tubes and the extension board can easily be produced by using low cost commercial parts such as plastic tubes and plywood, the material and tooling costs can thus be greatly reduced. If the structural strength of the central frame needs to be upgraded, stronger tubes such as steel or alloy tubes can be used. Various components such as hanger or lock can be installed to the front end of the extension board when required. Such a flexible, reliable, and low cost design provides great commercial advantages for wheeled luggage equipped with such central frame.

Besides, since the two rectangular tubes are slidably connected to the lower end of the rear panel of the L-shaped head set, only the downward pushing forces from the L-shaped head set will be passed to the two rectangular tubes. If a carrying handle is to be installed to the top panel of the L-shaped head set for hand-carrying the wheeled suitcase, the pulling force from the L-shaped head set will be isolated by the slidable connection between the L-shaped head set and the two rectangular tubes and thus avoids structural damage to the L-shaped head set.

These and other objects and the advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
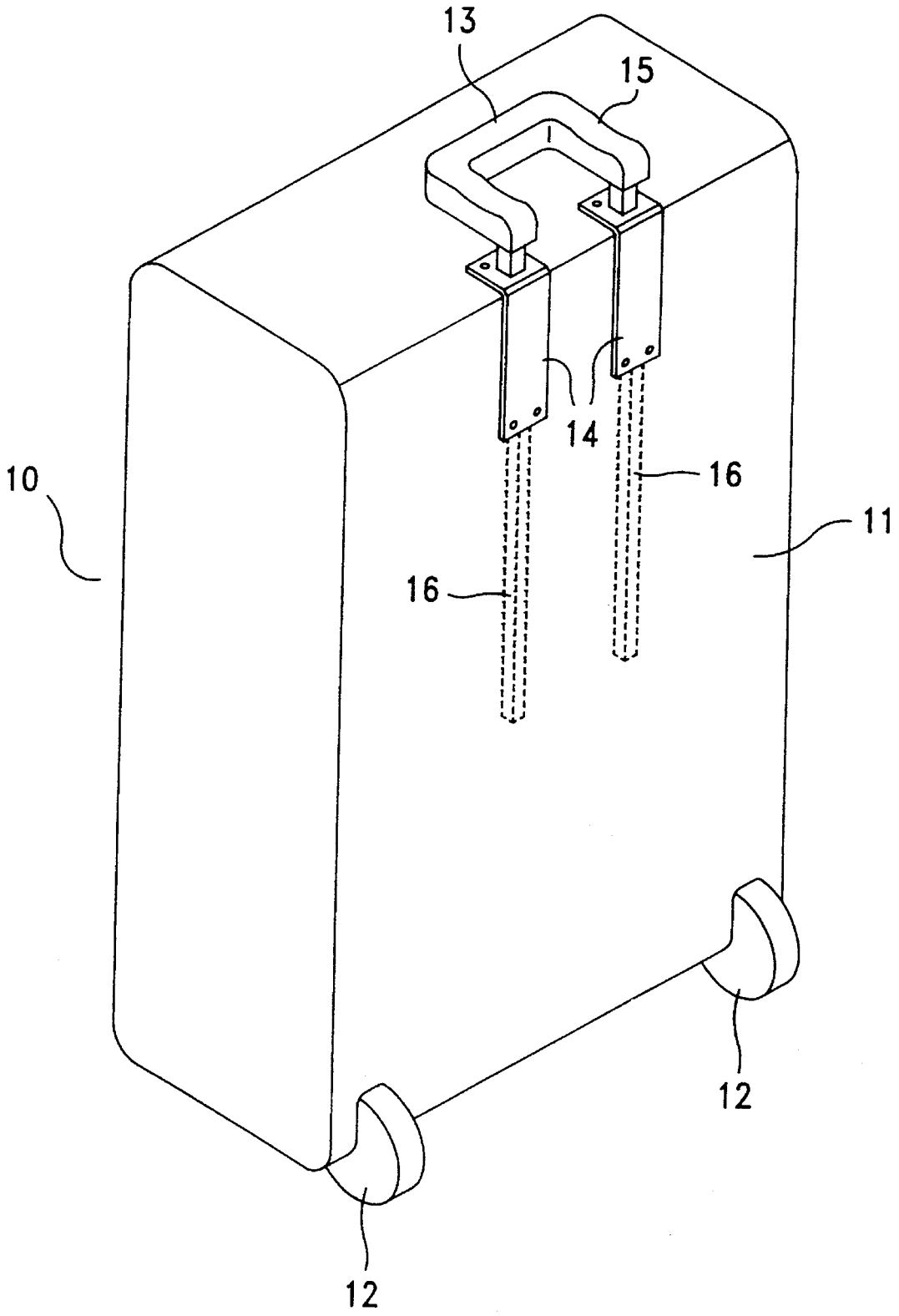
FIG. 1 is a perspective view of a wheeled suitcase according to the present invention.

FIG. 1 is a perspective view of a substantially rectangular wheeled suitcase 10 according to the present invention. The wheeled suitcase 10 comprises a flexible cover 11 as its outer layer, two wheels 12 on its rear bottom end, a U-shaped pull handle 13 connected to the upper end of the wheeled suitcase 10 for pulling the wheeled suitcase, and a rod receiving means 14 for slidably receiving the pull handle 13. The pull handle 13 comprises a gripping handle 15 and two parallel rod members 16 connected to the lower end of the gripping handle 15. The two rod members 16 are slidably engaged in the rod receiving means 14.

Figure 2:
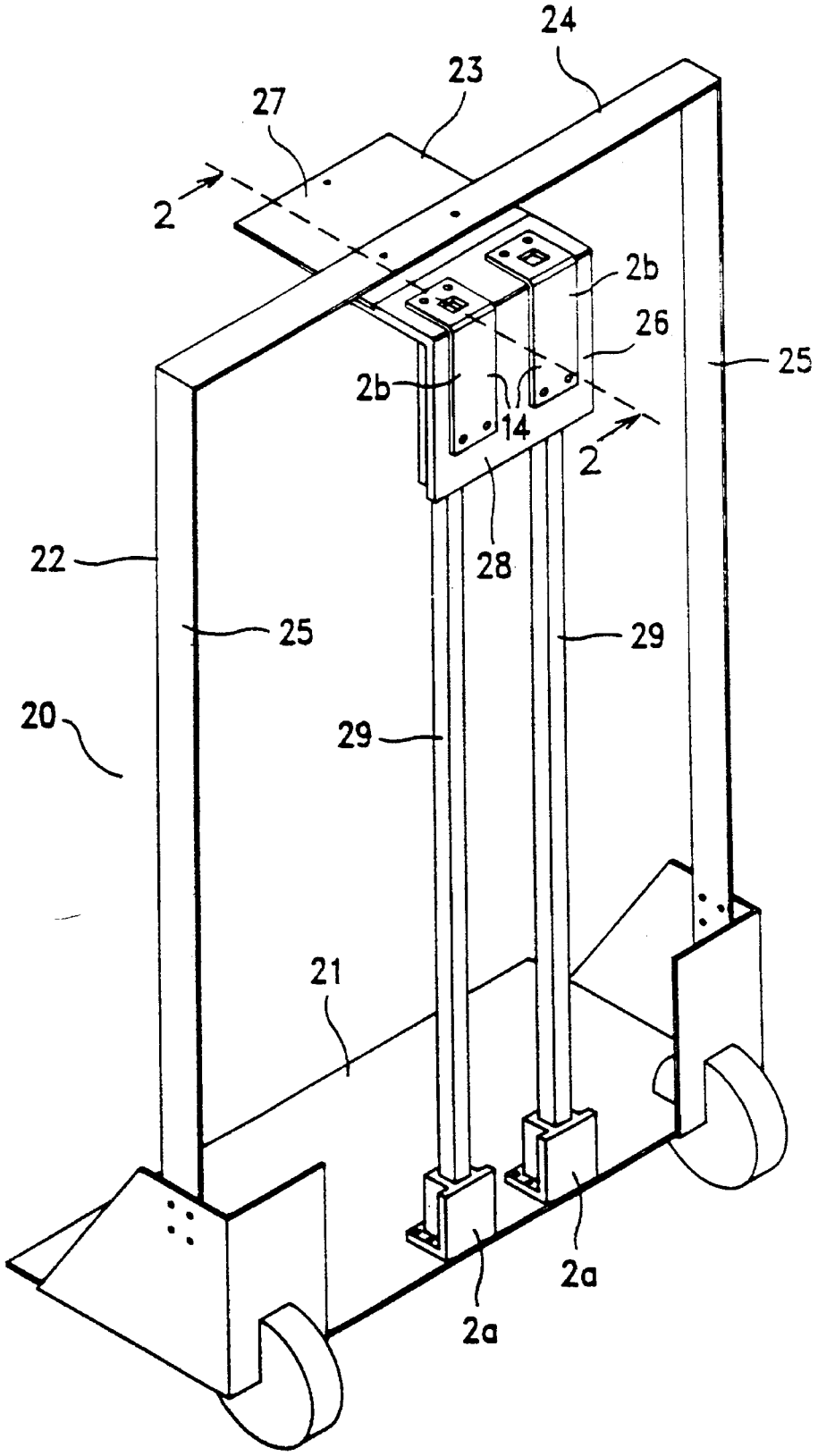
FIG. 2 is a perspective view of an internal frame of the wheeled suitcase shown in FIG. 1.

FIG. 2 is a perspective view of an internal frame 20 of the wheeled suitcase 10 shown in FIG. 1. The internal frame 20 comprises a base 21, a U-shaped frame 22, and a central frame 23. The U-shaped frame 22 comprises a top panel 24 and two side panels 25. The lower ends of the two side panels 25 are vertically mounted to the left and right sides of the base 21. The central frame 23 comprises an L-shaped head set 26 having a top panel 27 and a rear panel 28, two elongated supporting members 29 slidably connected to the lower end of the rear panel 28 of the L-shaped head set 26, and two sockets 2*a* rigidly connected to the lower ends of the two supporting members 29. The central frame 23 is mounted between the base 21 and the U-shaped frame 22 by having the middle section of the top panel 27 of the L-shaped head set 26 mounted to the top panel 24 of the U-shaped frame 22 and the two sockets 2*a* on the lower end of the central frame 23 mounted to the rear end of the base 21.

The top panel 27 of the L-shaped head set 26 is mounted under the top panel 24 of the U-shaped frame 22 for supporting the U-shaped frame 22 upward, and the tension from the U-shaped frame 22 also provides some holding power to the top panel 27 to prevent it from bending downward when the whole internal frame 20 is tightly wrapped by the flexible cover 11 of the wheeled suitcase 10. Such coupling provides great structural strength to the top end of the wheeled suitcase 10, and also the structure of the internal frame 20 is greatly strengthened by the central frame 23. The front end of the top panel 27 of the L-shaped head set 26 can thus be used to support an external suitcase hanging over the front upper end of the wheeled suitcase 10.

Each of the supporting members 29 is a substantially rectangular elongated tube. The two supporting members 29 and sockets 2*a* function as a supporting mechanism for vertically supporting the L-shaped head set 26. The two rectangular tubes 29 can be replaced by two round tubes or other similar structures as long as they can provide enough structural strength to support the L-shaped head set 26. The height of the central frame 23 can be changed by changing the two rectangular tubes 29. The two rectangular tubes 29 can be made by using low cost commercial parts such as plastic tubes. If the structural strength of the central frame is of great concern, stronger tubes such as steel or alloy tubes can also be used.

The central frame 23 further comprises a rod receiving means 14 on its rear side for receiving the two rod members 16 of FIG. 1. The rod receiving means 14 comprises two head pieces 2*b* installed on its upper end for guiding the upper parts of the two rod members 16. The two rectangular tubes 29 are also part of the rod receiving means for slidably receiving the lower ends of the two rod members 16. The flexible cover 11 of the wheeled suitcase 10 shown in FIG. 1 is clamped between the two head pieces 2*b* and the L-shaped head set 26 by using eight screws.

Figure 3:
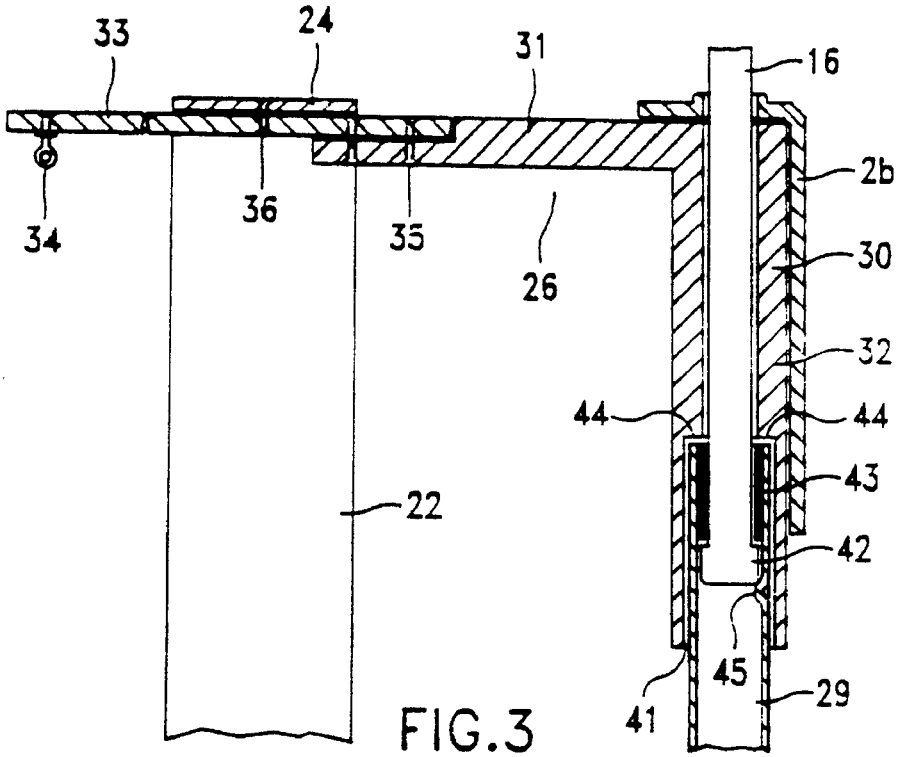
FIG. 3 is a sectional view 2—2 of the upper end of the internal frame shown in FIG. 2.
Figure 4:
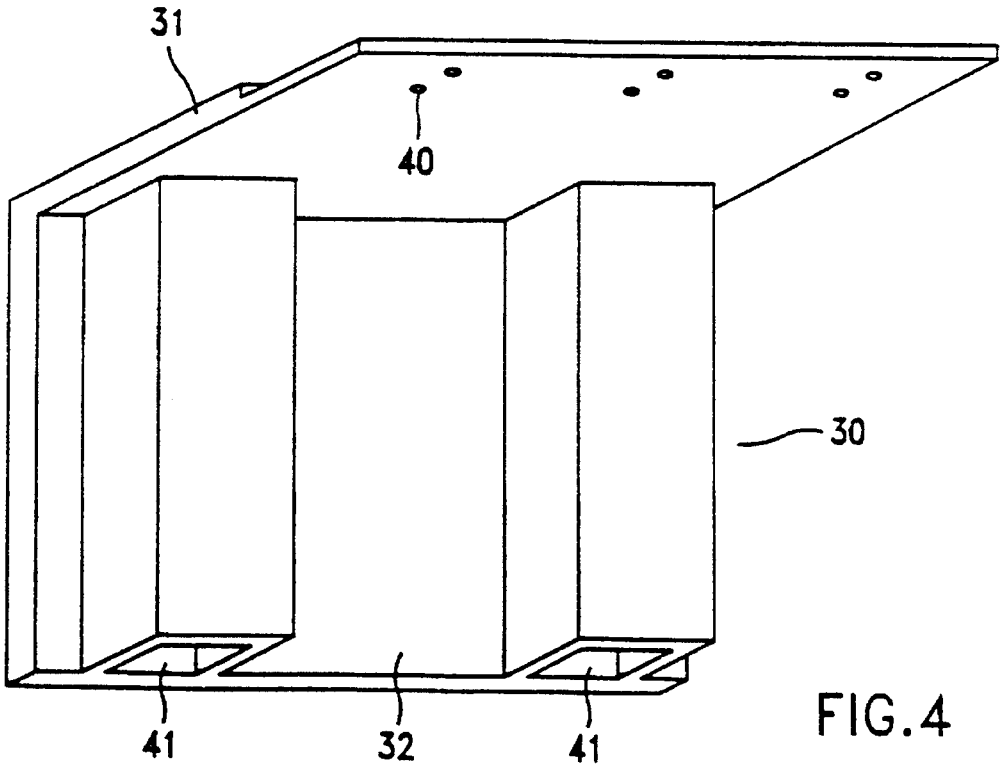
FIG. 4 is a perspective view of the L-shaped brace shown in FIG. 3.

FIG. 3 is a sectional view 2—2 of the upper end of the internal frame 20 shown in FIG. 2, and FIG. 4 is a perspective view of the L-shaped brace 30 shown in FIG. 3. The L-shaped head set 26 comprises an L-shaped brace 30 having a top panel 31 and a rear panel 32, and an extension board 33 horizontally fastened to the front end of the top panel 31 of the L-shaped brace 30 by fasteners 35 through the fastening holes 40. The upper end of the extension board 33 is fastened to the top panel 24 of the U-shaped frame 22 for supporting the top panel 24. The front end of the extension board 33 comprises a hanging means 34 installed on its lower end for hanging clothes within the wheeled suitcase 10. The extension board 33 can be made by using some low cost material such as plywood. Extension boards with different functions or forms can be used for different purposes. Other components a such as suitcase lock can also be installed over the front end of the extension board when required. The length of the extension board 33 can be adjusted for wheeled suitcases with different sizes, and thus avoids the tooling change over the L-shaped brace 30.

The lower end of the rear panel 32 of the L-shaped head set 26 comprises two recesses 41 for slidably receiving the two rectangular tubes 29 wherein the upper ends of the two rectangular tubes 29 are slidably plugged in the recesses 41 of the L-shaped head set 26. Each of the recesses 41 comprises a protruding edge 44 for engaging the upper end of each rectangular tube 29 so that pushing forces from the L-shaped head set 26 can be passed to the two rectangular tubes 29. Each of the rod members 16 further comprises a rod guide 42 on its lower end for guiding the rod member 16 within each rectangular tube 29 and each of the tubes 29 further comprises a correspondent rod stop 43 on its upper end for keeping the rod guide 42 within each tube 29. Each of the tubes 29 further comprises a rod detention 45 for confining each rod member 16 to its utmost position.

The rod stop 43 not only can keep the rod member 16 within each rectangular tube 29, but also can be used as the main supporting structure when pulling the wheeled suitcase 10 upward by using the pull handle 13. Since the pulling force will directly pass from the two rod members 16 to the two rectangular tubes 29, the L-shaped head set will take no pulling force and thus will not be damaged. If a carrying handle is installed at the center of the top panel 27 of the L-shaped head set 26 for hand-carrying the wheeled suitcase 10, the pulling force received by the L-shaped head set 26 from the carrying handle will be isolated by the slidable connection between the L-shaped head set 26 and the two rectangular tubes 29 and thus avoids structural damage to the corner part of the L-shaped head set 26. In this case the L-shaped head set 26, U-shaped frame 22 and the flexible cover 11 will become the main supporting structure for pulling the wheeled suitcase 10 upward.

The modular central frame design shown in FIGS. 2–4 not only can strengthen the structure of a wheeled suitcase 10, but is also flexible for change. The height of the central frame 23 can be changed by changing the two rectangular tubes 29, and the length of the top panel 27 of the L-shaped head set 26 can also be changed by changing the extension board 33. Since the rectangular tubes 29 and the extension board 33 can easily be produced by using low cost commercial parts such as plastic tubes and plywood, the material and tooling costs can thus be greatly reduced. If the structural strength of the central frame 23 needs to be upgraded, stronger tubes such as steel or alloy tubes can be used. Various components such as a hanging means or lock can also be installed to the front end of the extension board when required. Such a flexible, reliable, and low cost design provides great commercial advantages for wheeled suitcases equipped with such a central frame.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An internal frame for supporting a substantially rectangular wheeled suitcase having a flexible cover as its outer layer, the internal frame comprising:

(1) a base;

(2) a U-shaped frame having a top panel and two side panels, the lower ends of the two side panels vertically mounted to the left and right sides of the base; and (3) a central frame comprising:

(a) an L-shaped head set having a top panel and a rear panel, said rear panel further comprising two recesses on its lower end; and (b) two elongated parallel tubes vertically and slidably plugged in the two recesses of the L-shaped head set for undertaking pushing force only from the L-shaped head set;

wherein the central frame is mounted between the base and the U-shaped frame by having the top panel of the L-shaped head set mounted to the top panel of the U-shaped frame and the lower ends of the two elongated tubes mounted to the rear end of the base.

2. The internal frame of claim 1 further comprising a U-shaped pull handle having a gripping handle and two parallel rod members and the lower ends of two rod members are slidingly received by the two elongated tubes.

3. The internal frame of claim 2 wherein each of the rod members further comprises a rod guide on its lower end for guiding the rod member within each tube and each of the tubes further comprises a correspondent rod stop on its upper end for keeping the rod guide within each tube.

4. The internal frame of claim 1 wherein each of the tubes is a substantially rectangular tube.

5. The internal frame of claim 1 wherein the top panel of the L-shaped head set is mounted under the top panel of the U-shaped frame for supporting the top panel of the U-shaped frame upward.

6. The internal frame of claim 1 wherein the L-shaped head set comprises an L-shaped brace having a top panel and a rear panel which defines said rear panel of said head set and an extension board horizontally connected to the front end of the top panel of the L-shaped brace to define said top panel of said head set.

7. The internal frame of claim 6 wherein the L-shaped head set further comprises a hanging means installed to the front end of the extension board for hanging clothes within the wheeled suitcase.

8. The internal frame of claim 6 wherein the extension board is made of plywood.

9. The internal frame of claim 1 wherein the wheeled suitcase further comprises two head pieces and fastening means for clamping the flexible cover of the wheeled suitcase between the two head pieces and the L-shaped head set.

* * * * *